United States Patent [19]

Wrightman

[11] Patent Number: 4,599,837

[45] Date of Patent: Jul. 15, 1986

[54] LOG JOINING CONFIGURATION

[76] Inventor: Ronald A. Wrightman, P.O. Box 268, Minden, Ontario, K0M 2K0, Canada

[21] Appl. No.: 531,586

[22] Filed: Sep. 13, 1983

Related U.S. Application Data

[63] Continuation of Ser. No. 269,354, Jun. 1, 1981, abandoned.

[51] Int. Cl.[4] ..... E04B 1/10; E04C 1/10

[52] U.S. Cl. ..... 52/233; 52/586; 403/297

[58] Field of Search ..... 52/284, 569, 582, 584, 52/585, 586, 593, 726, 233; 403/292, 294, 297; 446/85

[56] References Cited

U.S. PATENT DOCUMENTS

| | | | |
|---|---|---|---|
| 201,378 | 3/1878 | Allen | 403/297 |
| 727,862 | 5/1903 | Taylor | 52/586 |
| 1,059,744 | 4/1913 | Webster | 52/233 |
| 1,365,726 | 1/1921 | Potts | 52/582 |
| 1,617,527 | 2/1927 | Knight | 52/586 |
| 2,225,612 | 12/1940 | Allen | 52/586 |
| 2,289,018 | 7/1942 | Jonsrud | 52/586 |
| 2,403,934 | 7/1946 | Lindstrom | 52/233 |

FOREIGN PATENT DOCUMENTS

| | | | |
|---|---|---|---|
| 426535 | 4/1935 | United Kingdom | 52/233 |
| 2040337 | 8/1980 | United Kingdom | 52/233 |

*Primary Examiner*—Alfred C. Perham
*Assistant Examiner*—Jean M. LaKemper
*Attorney, Agent, or Firm*—Fetherstonhaugh & Co.

[57] ABSTRACT

A butt joint for ends of logs when built into a log cabin. It involves the formation of opposed channels in the butted ends of the log with a drill so that complementary shaped locking members can be driven into the channels and then wedged into tight engagement therewith to join the butted ends.

3 Claims, 7 Drawing Figures

LOG JOINING CONFIGURATION

This application is a continuation of application Ser. No. 06/269,354, filed June 1, 1981, now abandoned.

BACKGROUND OF THE INVENTION

This invention relates to the butt jointing of structural members in the nature of wooden logs used in the construction of a log cabin.

In the building of log cabins, logs having a thickness of six to ten inches are laid one over the other to form the walls of the cabin. It is seldom that a single log will be long enough to form a full length of the wall of which it is a part, and there is a necessity in log cabin construction to provide a means for joining the ends of the logs. The traditional method is to have the ends of all logs in a wall terminate at the same location in the wall and to overlap the ends of joined logs that constitute the length of the wall. The overlapping logs are bolted together. This practice is wasteful because all logs do not start out by being the same length, but must be cut to a common length. Methods for avoiding this waste wherein the logs are joined at their ends wherever the ends should occur having regard to the original length of the log, have been proposed. Joining logs in this way involves a butt joint and the sealing of the joint. Various sealing methods have been devised for sealing the ends of logs so butted in the side of a building. They are an improvement over the traditional method because they save lumber. However, those methods of which I am aware leave considerable to be desired from the point of view of providing an air tight strong butted joint that can be easily and quickly assembled.

SUMMARY OF THE INVENTION

This invention achieves an air tight strong butted joint for two abutting logs that can be easily and quickly assembled and that can be economically manufactured. It is an object of this invention to provide a butted joint having these characteristics and also to provide an accurate and efficient method for preforming the surfaces of the logs to be butt jointed.

According to this invention butt jointable structural members each have a butting surface disposable in abutting relation with the butting surface of the other; a channel with an opening and with opposed side walls that diverge and extend across the butting surface of each structural member, the openings of the channels of the butting surfaces facing each other with the longitudinal axes of the channels in parallel relation when the members are in abutting relation; a pair of cooperating locking members each having a longitudinally extending locking surface that is complementary to a portion of the side wall of the channel of each structural member adjacent the openings of the channels when the structural members are in abutting relation; and wedge members wedgeable between the locking members to force the locking surfaces thereof apart and into close locking relation with the sides of the channels of the structural members to maintain the structural members in abutting relation.

The joint involves the formation of an open channel in the butting surface of a log and the method for forming structural members to be joined in locked butting relation according to this invention comprises the steps of projecting the member along a predetermined path having a direction at right angles to the direction of the open channel to be formed therein; stopping the member at a predetermined location on the path and clamping it at the location where it is stopped to dispose the butting surface of the member in predetermined location on the path of travel of the member; moving a drill along a drill path that is predetermined in relation to the predetermined location where said member was stopped as aforesaid, and that is at right angles to the butting surface of the member stopped as aforesaid, and that will carry the drill to bore an open channel in the butting surface of said stopped member; unclamping the member and continuing the member along and beyond said predetermined path. The invention will be clearly understood after reference to the following detailed specification read in conjunction with the drawings.

BEST MODE FOR CARRYING OUT THE INVENTION

Figure 7:
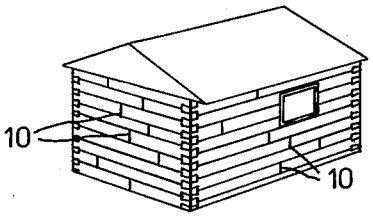
FIG. 7 is an illustration of a log building where the butted joint of this invention is useful.
Figure 6:
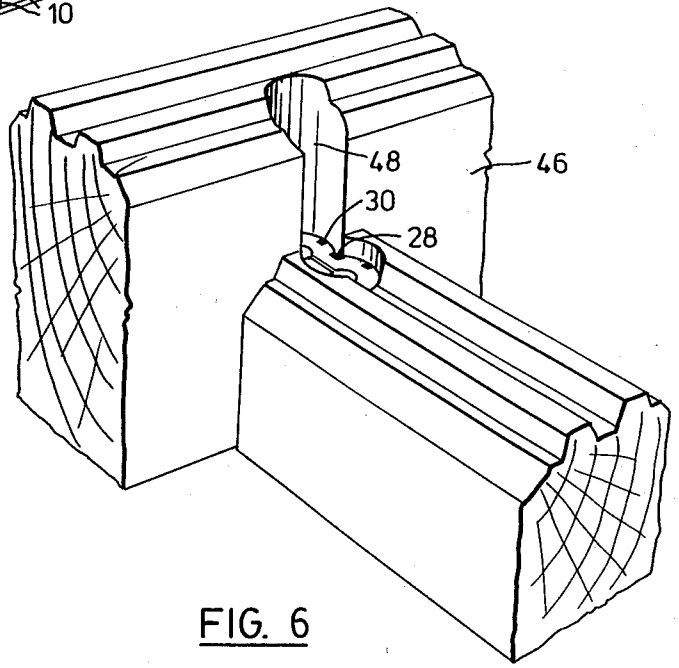
FIG. 6 is an illustration of logs butted at right angles to each other.

Referring to the drawings and at first to FIG. 7 which illustrates a log building the sides of which are made from milled logs similar to the milled logs illustrated in the drawings of this application. These logs are joined at their corners by a corner joint which can be similar to a corner joint illustrated in a copending application of mine. The logs which go into the building are of various lengths and are butt jointed where they meet in the side of the building as indicated by the vertical lines 10 in FIG. 7. The joining of logs at the ends where they meet in the side of a building as illustrated in FIG. 7 is an important contemplated use of this invention but it is not intended that the invention be restricted to that particular use. It has application wherever logs or the like are butt jointed and among other applications includes the butt jointing of the end of a log to the side of a log as illustrated in FIG. 6 of the drawings of this application.

The logs illustrated in this application are formed from wood and have their upper edges 12 and lower edges 14 formed with a tongue-and-groove configuration for convenient interlock as they are built into the wall of a building or the like. They are commonly 6 to 8 inches in thickness and as previously indicated in this application are butt jointed at their ends in the side wall of a building.

Figure 3:
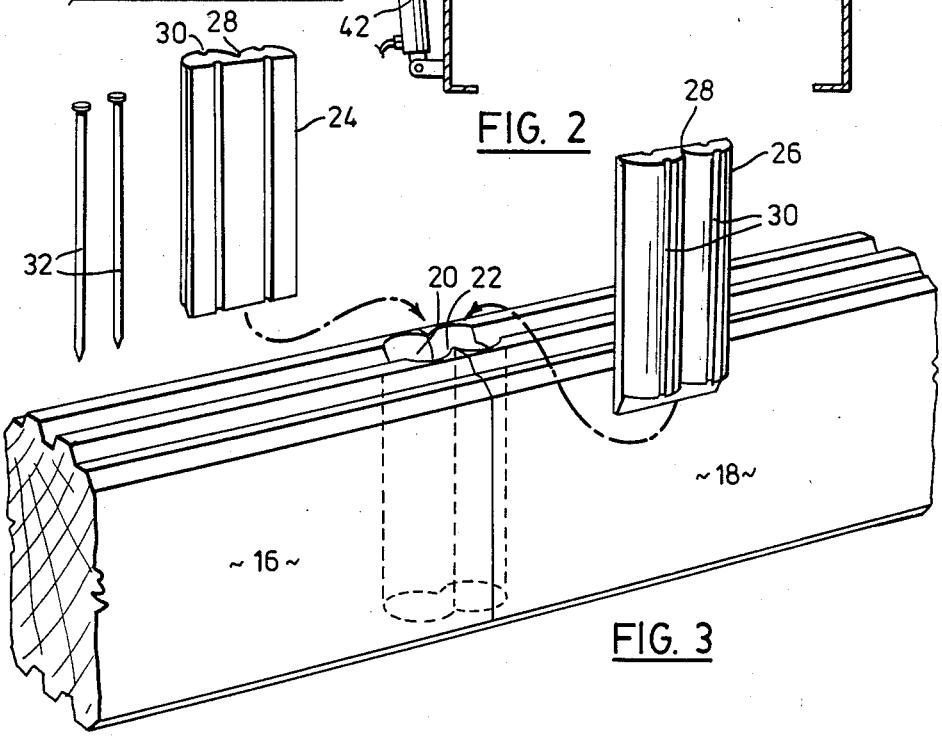
FIG. 3 is an illustration of two logs end butted together with locking members and wedge pins for insertion into the channels.

Reference will be made to FIG. 3 wherein the ends of two logs 16 and 18 are illustrated with their end butting surfaces disposed in abutting relation. Each of the butting surfaces is formed with an open channel 20 and 22 respectively. These channels are formed by a drilling operation as will be explained later. It will be noted that the side walls of each of the channels diverge from each other from the channel opening that extends across the butting end surface of the logs. It is the divergence of the side walls that, in use, achieves the locking relation between the joined logs as will be explained later.

Figure 5:
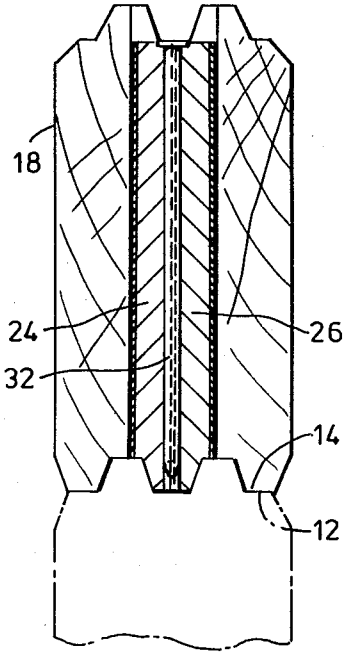
FIG. 5 is an illustration along the line 5—5 of FIG. 4.
Figure 4:
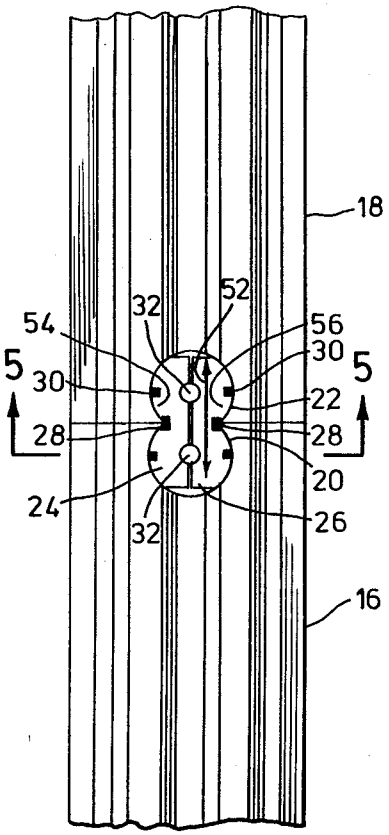
FIG. 4 is a top view of two logs joined together at their butting surfaces.

The openings in the channels 20 and 22 align with each other as is apparent from FIGS. 3 and 4 and, in use, a pair of locking members 24 and 26 are inserted into the channels. These locking members have curved surfaces 54 and 56 that are complementary to a side wall of each of the channels 20 and 22. They are of a dimension that they can be losely inserted into the aligned channels with a reasonable amount of clearance between their surfaces 54 and 56 and the side walls of the channels. Once inserted wedging spikes 32 are driven into the aligned channels in the opposed surfaces of the locking members to spread them apart and force the complementary formed walls 54 and 56 of the locking members into tight relationship with the side walls of the channel. The butting surfaces of the locking members are spaced apart so that as they are tightened into the channels of the members 16 and 18 they draw the butting surfaces of the logs tightly together as illustrated in FIGS. 4 and 5.

It will be apparent that logs joined as described herein are locked securely together and that the securement is easily and quickly achieved without the requirement of fitting skill on behalf of the assembling mechanic.

The locking members 24 and 26 are preferably milled from wood and it will be noted that they are formed at their lower ends to conform to the shape of the tongue and groove formation at the edge of the log below and that their upper ends are flush with the groove of the log they enter.

The open channels of the logs are preferably formed with machinery that is capable of transporting the log to a predetermined position where it is clamped and drilled. The conveying, clamping and drilling operation are interrelated for the handling of logs that are used in a log type building of the nature illustrated in FIG. 7.

Figure 2:
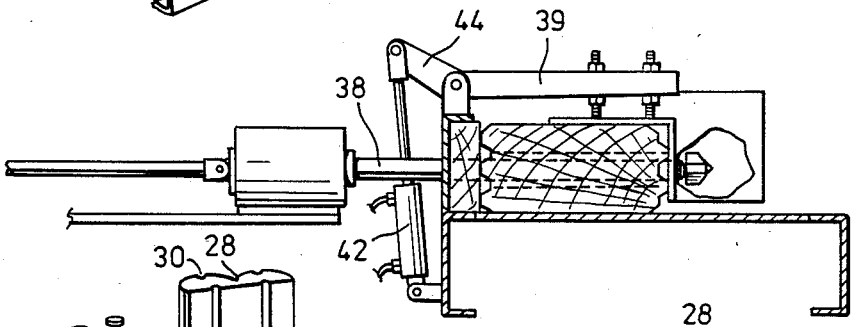
FIG. 2 is an illustration along the line 2—2 of FIG. 1.

FIG. 2 shows a portion of a conveyor 34 for a log which has a back guide 37 to positively locate the log and determine the path upon which it is projected towards the drill 38. It will be appreciated that only a portion of the conveyor is shown and that in practice the conveyor will be of a length well able to support the largest log that is used in a building such as the building illustrated in FIG. 7.

The logs 16 are projected along the conveyor and are arrested in the path by means of a stop member 36 which is located on the bench by an operator as required. Stop member 36 is located to stop the log so that its end butting surface will be engaged by the drill bit of the drill 38 as the drill bit is moved in its path of movement which is at right angles to the path of movement of the log along the conveyor 34.

Figure 1:
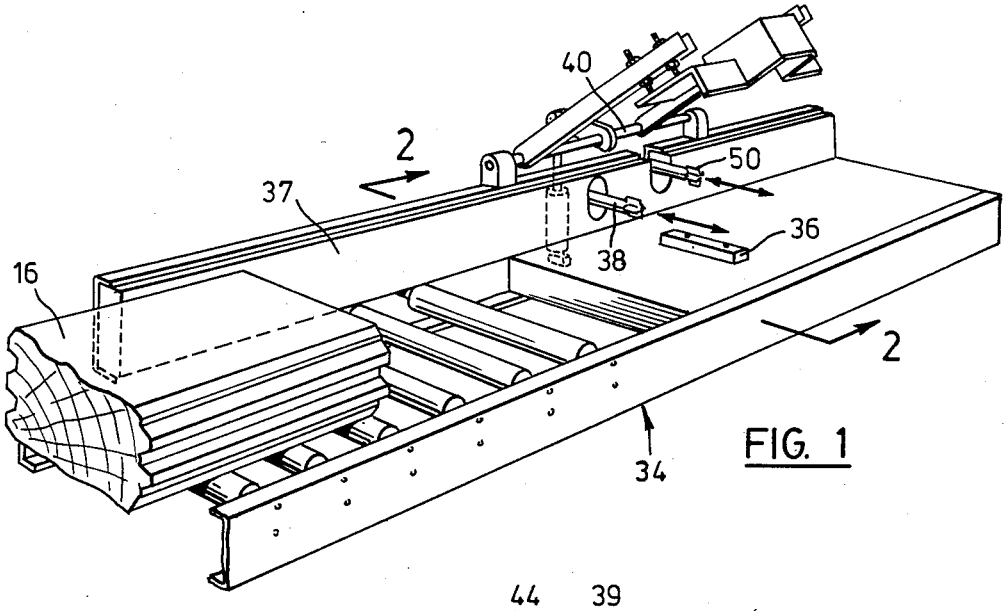
FIG. 1 is a partial illustration of apparatus used to form logs with a channel for incorporation into a butted joint according to the invention.

When the log has reached the stop member 36 it is clamped into position by means of the hydraulicly operated clamp 39. Clamp 39, it will be noted, is mounted on shaft 40 which is caused to rotate to move the clamping members from the position illustrated in FIG. 1 to the position illustrated in FIG. 2 through the operation of the hydraulic cylinder 42 and the crank arm 44.

Once clamped the drill 38 is reciprocated in its path to cause the drill to drill the channel in the end of the clamped log. FIG. 2 illustrates a drill in its most extended position.

After the drill has been operated to form a channel 20 in log 16 the drill is stopped from rotation and withdrawn. The log is unclamped, the stop member 36 is removed and the log is moved forward for removal from the conveyor.

The mating log is then drilled in a similar fashion, but in this case the log is stopped as it is moved from the opposite direction so that the opposite abutting face can be drilled. It will require a differently located stop.

The logs so drilled, one after the other, are joined in use. Preferably they are marked at the time of drilling so that when it comes time for assembly and joining logs that are drilled sequentially are joined together. A two inch diameter drill is a satisfactory size for a six inch thick log.

FIG. 6 illustrates logs joined together wherein the butting surfaces are an end surface of one log and a side surface of another log. In this case it is necessary to form the channel in the side surface of the log 46. This is achieved by appropriately stopping the log as explained above and operating a drill similar to the drill 38, but disposed to drill a hole in the top surface of the log to form the channel 48 which in function is similar to the channels drilled in the ends of the logs previously described.

Drill 50 is adjustable as to height to drill logs of different depth and to drill the side surfaces of logs as for the joint of FIG. 6. Detailed reference to the mounting of the drill is not made. It is a matter of mechanical skill to mount a drill with vertical adjustment to drill a log stopped in a predetermined location as described.

It is preferable that the locking members 26 and 28 should flex about the common central axis of the channels 20 and 22 when they are in abutting relation. This permits flexing to achieve ready and close cooperation of the complementary surfaces of the locking members and channels as the wedges 32 are driven into place. With a wooden locking member the flexing and strength is achieved by having the grain of the wood generally at right angles to the longitudinal axis of the locking members. The grain in this general direction is indicated by the numeral 52 on FIG. 4. It also adds strength to the locking members against splitting. If the grain were to run longitudinally of the locking members and be in general alignment with the direction of the spike wedging members the wedging force of the spikes would tend to split the locking members.

The portion of the locking members which achieve the locking action which, in use, pulls the two structural members 16 and 18 together as the wedges are driven into place are the locking surface portions 28 and 30 which are complementary to the portions of the side wall of the channels of the structural members adjacent the openings of the channels when the structural members are in abutting relation as indicated in FIG. 4. It will be apparent that as the wedge members are driven between the locking members they spread and these portions 54 and 56 engage with their corresponding complementary portions of the channels in the structural members to exert a force that will draw the members together due to the shape of the channels at their openings, i.e. the opposed side walls that diverge in cross section. It will be noted that the portions of the locking members that are at the bottom of the channels have been cut off to avoid any possible spreading action of the logs by the locking members.

It will be apparent that when the locking members are in place and extend for substantially the full length of the channel they form a block to the free passage of air across the butting surfaces. Preferably the locking members are formed with a longitudinally extending groove as indicated at the numeral 28 between the portions thereof that lock with the channels which is designed to receive a sealant. Numeral 30 also refers to a similar sealant channel.

Embodiments of the invention other than the one illustrated will be apparent to those skilled in the art. The joint can be used anywhere where there is a requirement to butt to wooden or similar surfaces. The invention has been described in relation to wood but it will be appreciated that it could be applied to materials such as substitutes for wood or any other materials where the joint configuration is useful.

What I claim as my invention is:

1. Butt joinable log members each having a butting surface disposed in abutting relation with the butting surface of the other in the construction of a wall;

a channel with an opening and with opposed side walls that diverge from the opening and extend fully across the butting surface of each log member, the openings of the channels of the butting surface facing each other with the longitudinal axes of the channels in parallel relation;

a pair of co-operating locking members each having a longitudinally extending locking surface and a wedging surface on the opposite side to the locking surface, the locking surface extending for the full length of said channels and being rigid and complementary to a portion of the side wall of the channel of each log member adjacent the openings of the channels where they diverge as aforesaid when the log members are in abutting relation; the portion of the locking surface of the locking member that is complementary to said portion of one channel being spaced from the portion of the locking surface that is complementary to said portion of the other channel a distance to maintain said logs in abutting relation as aforesaid;

the locking members having a thickness between their locking surface and their wedging surface to permit the pair of locking members to be inserted into the openings of the channels of butted log members with their wedging surfaces in face to face relation;

and a positioned in each of the channels wedged between the wedging surfaces of the locking members in a direction substantially parallel to the longitudinal axes of the channels to force the locking surfaces thereof apart and into close locking relation with the sides of the channels of the log members to draw and maintain the log members in abutting relation.

2. Butt jointable log members as claimed in claim 1 wherein said locking members are each made of wood and wherein the grain of the wood therein is generally at right angles to their longitudinal axis.

3. Butt jointable log members as claimed in claim 1 wherein the walls of said channel in the butting surface of each of said log members in cross section is a portion of a circle in cross section.

* * * * *